US006763820B1

(12) United States Patent
Pinto, Jr.

(10) Patent No.: US 6,763,820 B1
(45) Date of Patent: Jul. 20, 2004

(54) ARROW HOLD DOWN FOR COMPOUND BOW

(76) Inventor: Julian J Pinto, Jr., 721 Grove Rd., Thorofare, NJ (US) 08086

( * ) Notice: Subject to any disclaimer, the term of this patent is extended or adjusted under 35 U.S.C. 154(b) by 0 days.

(21) Appl. No.: 10/605,901

(22) Filed: Nov. 5, 2003

(51) Int. Cl.[7] ..... F41B 5/22
(52) U.S. Cl. ..... 124/44.5; 124/25.6
(58) Field of Search ..... 124/24.1, 25.6, 124/44.5, 86

(56) References Cited

U.S. PATENT DOCUMENTS 5,181,502 A * 1/1993 Ray ..... 124/44.5
5,454,362 A * 10/1995 Cook ..... 124/44.5
5,460,152 A * 10/1995 Specht ..... 124/44.5
5,697,356 A * 12/1997 Chappell ..... 124/44.5
6,035,842 A * 3/2000 Bradley ..... 124/44.5
6,044,832 A 4/2000 Piersons, Jr. ..... 124/44.5
6,082,348 A 7/2000 Savage ..... 124/44.5
6,102,020 A 8/2000 Mizek et al. ..... 124/44.5
6,202,635 B1 3/2001 Evans ..... 124/44.5
6,488,018 B2 * 12/2002 Hulm ..... 124/44.5

* cited by examiner

*Primary Examiner*—John A. Ricci
(74) *Attorney, Agent, or Firm*—John R. Merkling

(57) ABSTRACT

An arrow hold down for use with a compound bow having bow string cables and an arrow rest and a cable guard bar mounted above the arrow rest, the cable guard bar extending rearward from the bow and having a cable block on the cable guard bar. The arrow hold down comprises a pivot block secured to the cable guard bar and a holding apparatus in the pivot block. The holding apparatus comprises a forwardly extending arm with a tip to press against an arrow on the arrow rest and a rearwardly extending trigger. The trigger has a transverse portion that is struck by the cables of the bow as an arrow is shot. The arrow is held on the arrow rest by the tip of the forwardly extending arm. The tip is disengaged from the arrow by the motion of the cables or bowstring as the arrow is shot from the bow.

18 Claims, 4 Drawing Sheets

ARROW HOLD DOWN FOR COMPOUND BOW

BACKGROUND OF INVENTION

The invention relates to archery apparatus and in particular to an arrow hold down for holding an arrow against an arrow rest.

Apparatus for temporarily securing an arrow on an arrow rest of a bow are known in the art. An example is FAST-FLIP™ available from New Archery Products Corp (NAP) of Forest Park, Ill. These devices hold an arrow until the bow is drawn prior to a shot. In general, however, the act of drawing the bow releases the action of the apparatus. Therefore, as the bow is relaxed, the arrow must be re-secured. As it is common in bow hunting to draw and relax the bow if a shot has not presented itself, there remains need for the development of an arrow hold down that continues to secure an arrow until an arrow is actually shot from the bow.

SUMMARY OF INVENTION

I have invented an arrow hold down for use with a compound bow having bow string cables and an arrow rest and a cable guard bar mounted above the arrow rest, the cable guard bar extending rearward from said bow and having a cable block on said cable guard bar. The arrow hold down comprises a pivot block secured to the cable guard bar and a holding apparatus in the pivot block. The holding apparatus comprises a forwardly extending arm with a tip to press against an arrow on the arrow rest and a rearwardly extending trigger. The trigger has a transverse portion that is struck by the cables of the bow as an arrow is shot. The arrow is held on the arrow rest by the tip of the forwardly extending arm. The tip is disengaged from the arrow by the motion of the cables or bowstring as the arrow is shot from said bow.

DETAILED DESCRIPTION

Figure 1:
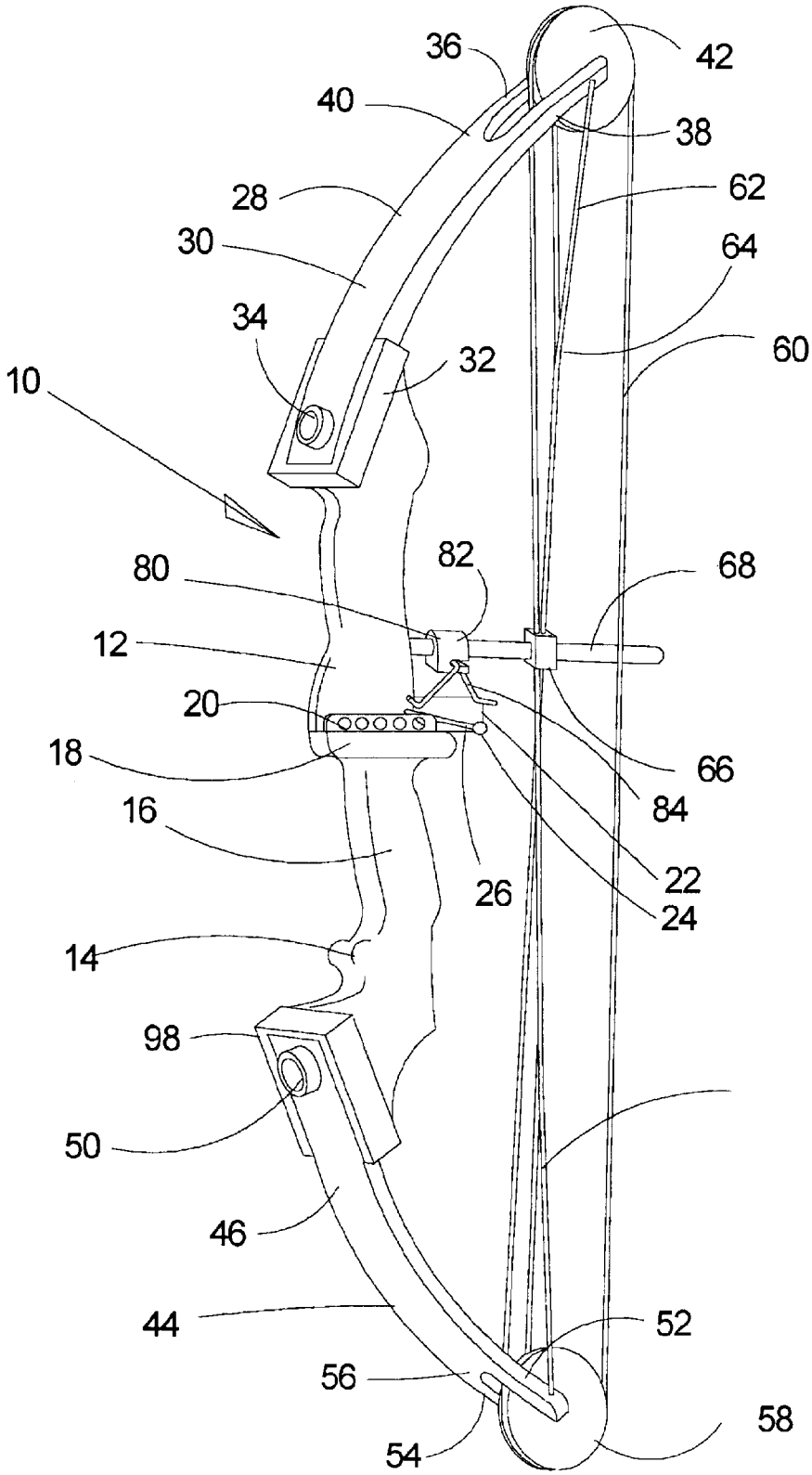
FIG. 1 is a perspective view of a bow having an arrow hold down according to the present invention.
Figure 2:
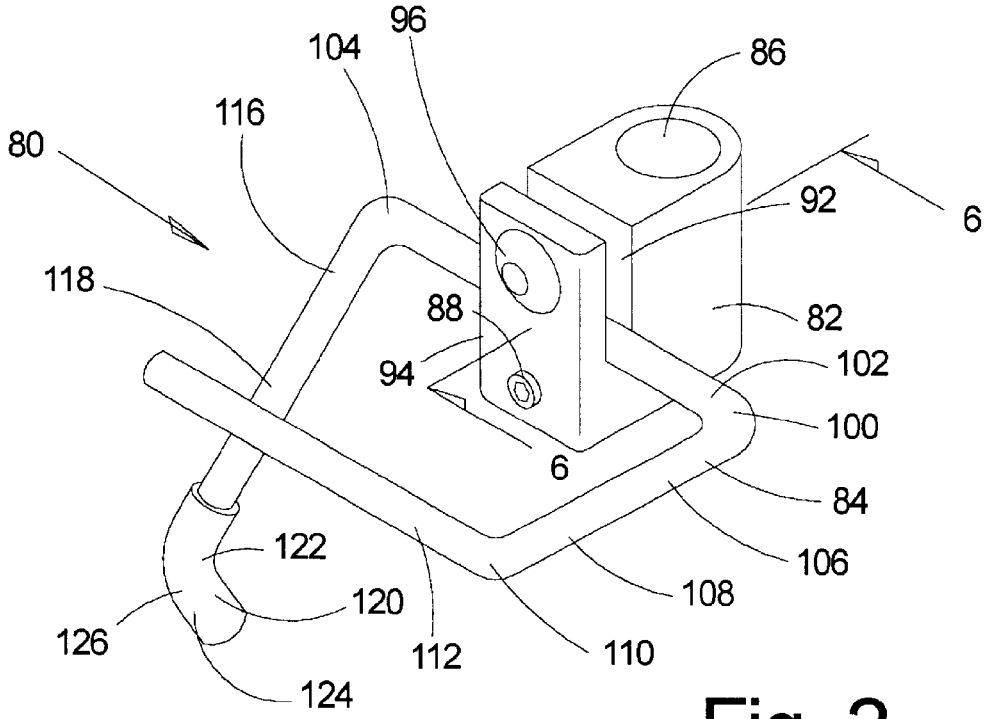
FIG. 2 is a perspective view of the arrow hold down.
Figure 3:
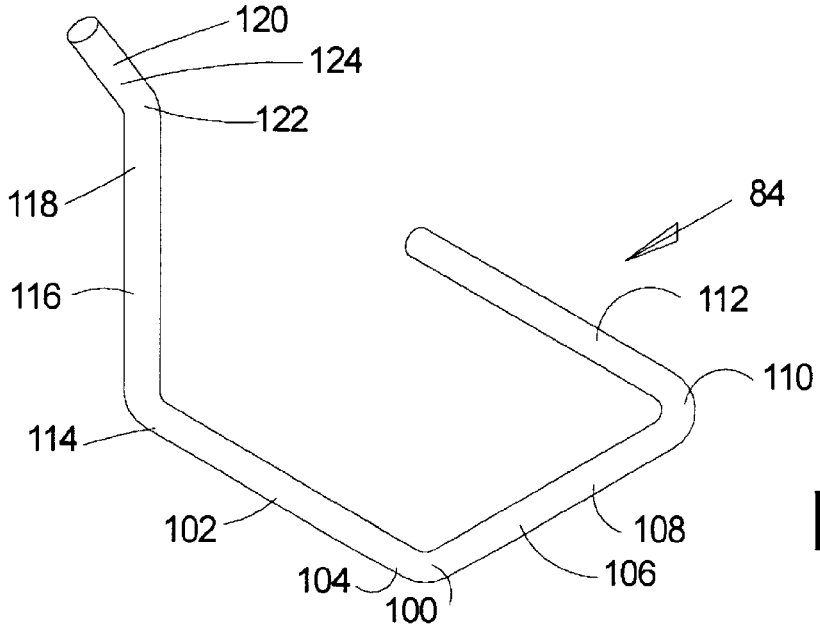
FIG. 3 is a perspective view of a holding apparatus.
Figure 4:
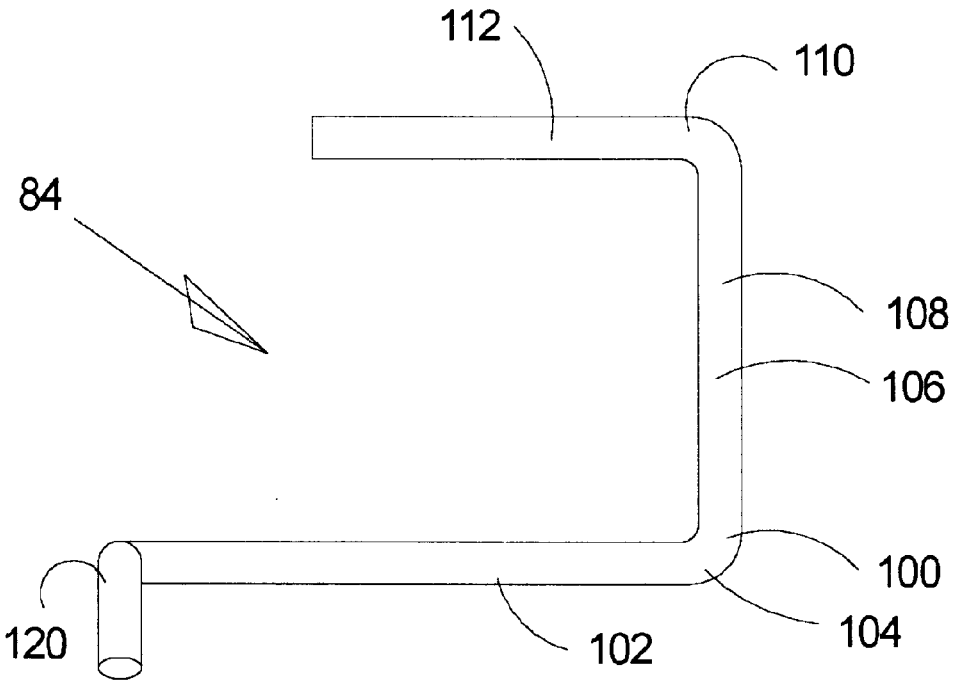
FIG. 4 is a top plan view of the holding apparatus of FIG. 3.
Figure 5:
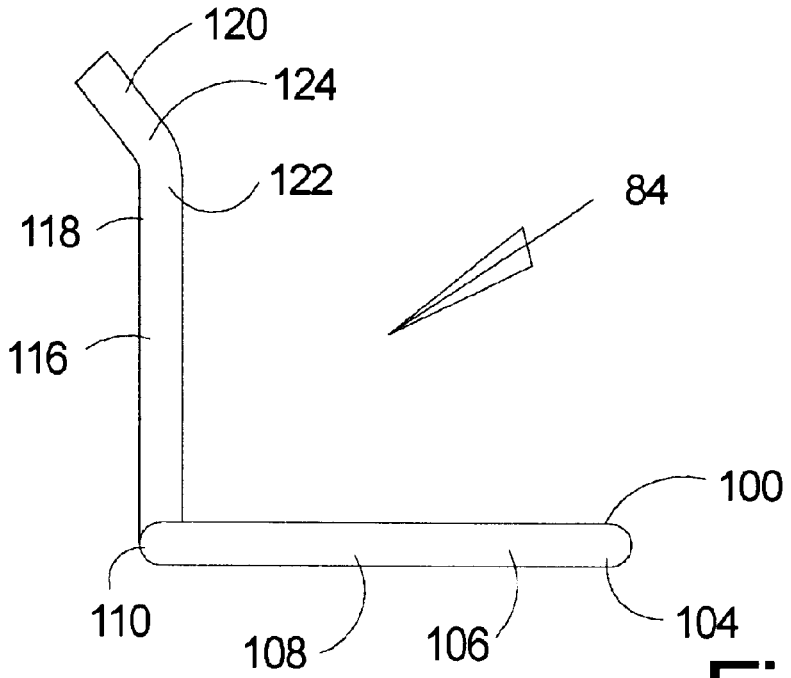
FIG. 5 is a side plan view of the holding apparatus of FIG. 3.
Figure 6:
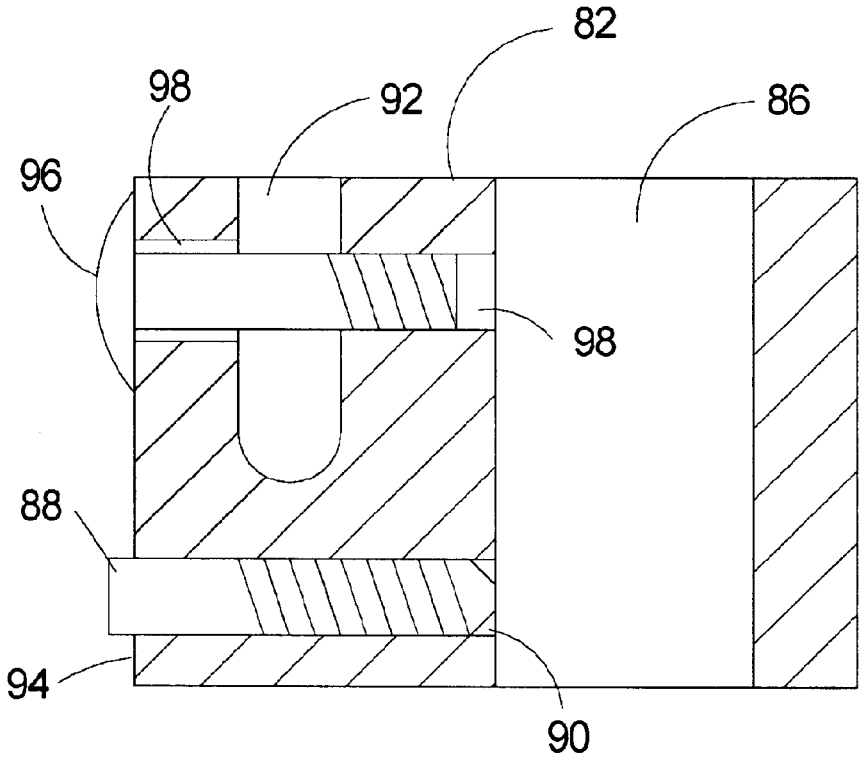
FIG. 6 is a through section of a pivot block of the arrow hold down take along line 6—6 of FIG. 2.

FIG. 1 shows a perspective view of a bow 10. The bow 10 comprises a central body 12 with a bow riser 14 and a grip 16. A bow riser shelf 18 on the bow riser 14 supports an arrow rest 20. The arrow rest 20 is of any suitable design, many of which are known in the art. The rest 20 may comprise such features as an adjustment mechanism 22 that laterally displaces a pivot 24. The pivot 24 has at least one and preferably two arms 26 upon which an arrow (not shown) may rest.

An upper bow limb 28 has a proximal end 30 that fits into an upper seat 32 on the central body 12 and is secured to the central body 12 by a limb-mounting bolt 34. Two opposed supports 36, 38 at a distal end 40 of the limb 28 provide a mounting for an upper wheel 42 or cam.

Similarly, a lower bow limb 44 has a proximal end 46 that fits into a lower seat 48 on the central body 12 and is secured to the central body 12 by a limb-mounting bolt 50. Two opposed supports 52,54 at a distal end 56 of the limb 44 provide a mounting for a lower wheel 58 or cam.

A bowstring or cable 60 has a yoke 62 at a first end 64. The yoke 62 fastens to the opposed supports 36, 38 of the upper bow limb 28 near the wheel 42. The bowstring passes through a cable guard or slide 66 that is slidingly mounted on a cable guard bar 68. The cable guard bar 68 extends rearwardly from the central body 12 above the bow riser shelf 18 and the arrow rest 20, as will be further explained below. After passing through the cable slide 66, the bowstring 60 passes around the lower wheel 58 from front to back and then extends upwardly to the back of the upper wheel 42, forming a section 70 of the bowstring 60 to which an arrow (not shown) may be notched. The bowstring 60 wraps around the upper wheel 42 from back to front and extends downwardly through the cable slide 66. At a second end 72, the bowstring 60 has a second yoke 74 fastened to the opposed supports 54, 56 of the lower bow limb 44 near the lower wheel 58.

An arrow hold down 80 is mounted on the cable guard bar 68 at any selected location between the central body 12 and the cable guide or slide 66. Because the cable guard bar 68 is above the arrow rest 20, the arrow hold down 80 can act against an arrow, holding the arrow on the arrow rest until the arrow is shot from the bow. As will be explained more fully below, the arrow hold down of this invention does not release the arrow when the bow is drawn, but only as the bowstring is released and the arrow is shot from the bow. This allows an archer to let down a drawn bow without shooting the arrow and without loosing the control provided by the hold down 80.

The hold down 80 comprises a pivot block 82 secured to the cable guard bar 68 and a holding apparatus 84 pivotally secured in said pivot block 82. The pivot block 82 may be constructed of any suitable material, for example, Delrin™ plastic. The pivot block 82 has a through bore 86 sized to slidingly receive the cable guard bar 68. A setscrew 88 in a threaded bore 90 tightens against the cable guard bar 68 to secure the pivot block at a selected location on the cable guard bar 68. A slot 92 in a lower end 94 of the pivot block 82 receives the holding apparatus 84. A button head clamp screw 96 in a partially threaded bore 98 closes the slot 92 and pinches the holding apparatus therein, allowing the resistance of the holding apparatus to be adjusted.

The holding apparatus 84 may be a stainless steel rod 100 having a pivot section 102 extending perpendicularly to the through bore 86 and the cable guard bar 68 and disposed in the slot 92 in the pivot block 82. At a first end 104 of the pivot section 102 there is a rearwardly extending trigger 106. The trigger 106 comprises a first rod portion 108 that is preferably perpendicular to the pivot section 102. At a distal end 110 to the first rod portion, a transverse portion 112 extends back towards the pivot block 82. The transverse portion is preferably substantially perpendicular to the first rod portion 108 and coplanar with and parallel to the pivot section 102.

At a second end 114 of the pivot section 102 there is a forwardly extending arm 116. The arm 116 comprises a second rod portion 118 having a tip 120 at a distal end 122 of the second rod portion 118. Preferably, the tip 120 comprises an upwardly bent portion 124 with an elastomeric sleeve 126. The second rod portion 118 is preferably generally perpendicular to the pivot section 102 and also generally perpendicular to the first rod portion 108. Thus, if the x-axis of an x-y-z orthogonal coordinate system were extended along the pivot section 102, the first rod portion 108 could extend parallel to the y axis, and the second rod portion could extend parallel to the z axis.

When the hold down 80 is mounted on the cable guard bar 68 of a bow 10, the tip 120 can be lowered to press against an arrow (not shown) notched in the bow and resting on the arrow rest 20. If the bow is drawn and the arrow is shot from the bow, momentum will carry the bowstring 60 forward so that the bowstring 60 strikes the transverse portion 112 of the trigger 106. Preferably, a part of the bowstring near the cable slide 66 strikes the transverse portion 112. This part of the bowstring is sometimes called the cable or cables. The action of the bowstring against the transverse portion 112 causes the holding apparatus 84 to pivot in the pivot block 82, raising the tip 120 off the arrow and allowing a clean release of the arrow. If the archer draws and then relaxes the bow without shooting, the hold down 80 will continue to hold the arrow securely on the arrow rest. The archer can again draw the bow and shoot the arrow without adjusting the hold down or loosing the effectiveness of the hold down in securing the arrow.

What is claimed is:

1. An arrow hold down for use with a compound bow having a bow string and an arrow rest and a cable guard bar mounted above said arrow rest, said cable guard bar extending rearward from said bow and having a cable block slidingly received on said cable guard bar, said arrow hold down comprising a pivot block secured to said cable guard bar and a holding apparatus pivotally secured in said pivot block, said holding apparatus comprising a forwardly extending arm having a tip adapted to press downwardly against an arrow on said arrow rest and a rearwardly extending trigger, said trigger having a transverse portion adapted to engage said bow string as an arrow is shot from said bow, whereby said arrow is held on said arrow rest by said tip and said tip is disengaged from said arrow in response to the motion of said bowstring as said arrow is shot from said bow.

2. The arrow hold down of claim 1 wherein said holding apparatus comprises a rod.

3. The arrow hold down of claim 2 wherein said rod further comprises a pivot section between said forwardly extending arm and said rearwardly extending trigger, said pivot section extending through said pivot block perpendicular to a shaft of said cable guard bar.

4. The arrow hold down of claim 3 wherein said rearwardly extending trigger comprises a first rod portion extending perpendicularly from a first end of said pivot section and wherein said transverse portion extends perpendicularly from a distal end of said first rod portion.

5. The arrow hold down of claim 4 wherein said transverse portion is substantially parallel to said pivot section.

6. The arrow hold down of claim 5 wherein said forwardly extending arm comprises a second rod portion extending perpendicularly from a second end of said pivot section and wherein said tip comprises an upwardly bent portion.

7. The arrow hold down of claim 6 wherein said second rod portion of said forwardly extending arm and said first rod portion of said rearwardly extending trigger lie in substantially parallel planes.

8. The arrow hold down of claim 7 wherein said second rod portion of said forwardly extending arm and said first rod portion of said rearwardly extending arm are substantially perpendicular.

9. The arrow hold down of claim 8 further comprising an elastomeric sleeve on said tip.

10. A compound bow having a body, flexible arms attached to said body, each arm having a cable pulley for receiving a bow string, an arrow rest and a cable guard bar mounted above said arrow rest, said cable guard bar extending rearward from said bow and having a cable block slidingly received on said cable guard bar, and an arrow hold down comprising a pivot block secured to said cable guard bar and a holding apparatus pivotally secured in said pivot block, said holding apparatus comprising a forwardly extending arm having a tip adapted to press downwardly against an arrow on said arrow rest and a rearwardly extending trigger, said trigger having a transverse portion adapted to engage said bow string as an arrow is shot from said bow, whereby said arrow is held on said arrow rest by said tip and said tip is disengaged from said arrow in response to the motion of said bowstring as said arrow is shot from said bow.

11. The compound bow of claim 10 wherein said holding apparatus comprises a rod.

12. The compound bow of claim 11 wherein said rod further comprises a pivot section between said forwardly extending arm and said rearwardly extending trigger, said pivot section extending through said pivot block perpendicular to a shaft of said cable guard bar.

13. The compound bow of claim 12 wherein said rearwardly extending trigger comprises a first rod portion extending perpendicularly from a first end of said pivot section and wherein said transverse portion extends perpendicularly from a distal end of said first rod portion.

14. The compound bow of claim 13 wherein said transverse portion is substantially parallel to said pivot section.

15. The compound bow of claim 14 wherein said forwardly extending arm comprises a second portion extending perpendicularly from a second end of said pivot section and wherein said tip comprises an upwardly bent portion.

16. The compound bow of claim 15 wherein said second rod portion of said forwardly extending arm and said first rod portion of said rearwardly extending trigger lie in substantially parallel planes.

17. The compound bow of claim 16 wherein said second rod portion of said forwardly extending arm and said first rod portion of said rearwardly extending arm are substantially perpendicular.

18. The compound bow of claim 17 further comprising an elastomeric sleeve on said tip.

* * * * *